US008898066B2

(12) United States Patent
Li et al.

(10) Patent No.: US 8,898,066 B2
(45) Date of Patent: Nov. 25, 2014

(54) MULTI-LINGUAL TEXT-TO-SPEECH SYSTEM AND METHOD

(75) Inventors: Jen-Yu Li, Taipei (TW); Jia-Jang Tu, Tainan (TW); Chih-Chung Kuo, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 555 days.

(21) Appl. No.: 13/217,919

(22) Filed: Aug. 25, 2011

(65) Prior Publication Data

US 2012/0173241 A1 Jul. 5, 2012

(30) Foreign Application Priority Data

Dec. 30, 2010 (TW) ..... 99146948 A
Jan. 30, 2011 (CN) ..... 2011 1 0034695

(51) Int. Cl.
*G10L 21/06* (2013.01)
*G10L 13/08* (2013.01)
*G10L 13/10* (2013.01)

(52) U.S. Cl.
CPC ..... *G10L 13/086* (2013.01); *G10L 13/10* (2013.01)
USPC ..... 704/277; 704/258

(58) Field of Classification Search
USPC ..... 704/258–269, 254, 255, 277
See application file for complete search history.

(56) References Cited

U.S. PATENT DOCUMENTS 5,271,088 A 12/1993 Bahler
6,141,642 A 10/2000 Oh
7,472,061 B1 12/2008 Alweine et al.
7,496,498 B2 2/2009 Chu et al.
7,596,499 B2 9/2009 Anguera Miro et al.
2004/0030556 A1 2/2004 Bennett
2004/0193398 A1* 9/2004 Chu et al. ..... 704/3
2005/0144003 A1 6/2005 Iso-Sipila
2005/0182630 A1 8/2005 Miro et al.
2007/0118377 A1* 5/2007 Badino et al. ..... 704/260
2007/0203703 A1 8/2007 Yoshida
2009/0055162 A1 2/2009 Qian et al.

FOREIGN PATENT DOCUMENTS

CN 1540625 A 10/2004
CN 101490739 A 7/2009
JP 1238697 A 9/1989
TW 1281145 5/2007
WO 2005/101905 A1 10/2005

OTHER PUBLICATIONS

Foreign-Language Speech Synthesis, Nick Campbell, 1998.

(Continued)

*Primary Examiner* — Abul Azad
(74) *Attorney, Agent, or Firm* — Rabin & Berdo, P.C.

(57) ABSTRACT

A multi-lingual text-to-speech system and method processes a text to be synthesized via an acoustic-prosodic model selection module and an acoustic-prosodic model mergence module, and obtains a phonetic unit transformation table. In an online phase, the acoustic-prosodic model selection module, according to the text and a phonetic unit transcription corresponding to the text, uses at least a set controllable accent weighting parameter to select a transformation combination and find a second and a first acoustic-prosodic models. The acoustic-prosodic model mergence module merges the two acoustic-prosodic models into a merged acoustic-prosodic model, according to the at least a controllable accent weighting parameter, processes all transformations in the transformation combination and generates a merged acoustic-prosodic model sequence. A speech synthesizer and the merged acoustic-prosodic model sequence are further applied to synthesize the text into an L1-accent L2 speech.

14 Claims, 8 Drawing Sheets

(56) References Cited

OTHER PUBLICATIONS

Experiments on Cross-Language Acoustic Modeling, T. Schultz and A. Waibel, 2001.
Foreign Accents in Synthetic Speech: Development and Evaluation, Laura Mayfield Tomokiyo, Alan W Black, Kevin A. Lenzo, 2005.
New approach to the polyglot speech generation by means of an HMM-based speaker adaptable synthesizer Javier Latorre , Koji Iwano, Sadaoki Furui, Received Sep. 20, 2005; received in revised form May 10, 2006; accepted May 11, 2006.
Foreign accent conversion in computer assisted pronunciation training, Daniel Felps, Heather Bortfeld, Ricardo Gutierrez-Osuna,Available online at www.sciencedirect.com, Received Jul. 1, 2008; received in revised form Nov. 12, 2008; accepted Nov. 17, 2008.
Input/Output Normalisation and Linguistic Analysis for a Multilingual Text-to-Speech Synthesis System, Philippe Boula de Mareiiil & Benoit Soulage,Aug. 29-Sep. 1, 2001.
Multilingual Text Analysis for Text-To-Speech Synthesis, Richard Sproat, Natural Language Engineering, vol. 2 Issue 4, Dec. 1996.
From Multilingual to Polyglot Speech Synthesis, Christof Traber, Karl Huber, Karim Nedir, Volker Jantzen, Eric Keller, Brigitte Zellner, 1999.
Mixed-Lingual Text Analysis for Polyglot TTS Synthesis, Beat Pfister and Harald Romsdorfer, Reprint from Proceedings of Eurospeech, Sep. 1-4, 2003, Geneva, Switzerland, 2003.
Microsoft Mulan—A Bilingual TTS System, Min Chu, Hu Peng, Yong Zhao, Zhengyu Niu and Eric Chang, ICASSP 2003.
Multilingual Text-To-Speech Synthesis, Alan W Black and Kevin A. Lenzo,ICASSP 2004.
Multi-Context Rules for Phonological Processing in Polyglot TTS Synthesis, Harald Romsdorfer and Beat Pfister, ICASSP 2004, Reprint from Proceedings of Interspeech 2004—ICSLP, Oct. 4-8, Jeju Island, Korea.
A Mixed-lingual Phonological Component which Drives the Statistical Prosody Control of a Polyglot TTS Synthesis System, Harald Romsdorfer, Beat Pfister, and René Beutler, MLMI 2004.
Character Stream Parsing of Mixed-lingual Text, Harald Romsdorfer and Beat Pfister,Reprint from MultiLing Apr. 9-11, 2006, Stellenbosch, South Africa.
Investigating Prosodic Modifications for Polyglot Text-to-Speech Synthesis, Péter Olaszi, Tina Burrows, Kate Knill, MultiLing 2006.
Speaker-Independent HMM-based Speech Synthesis System—HTS-2007 System for the Blizzard Challenge 2007 Junichi Yamagishi, Heiga Zen, Tomoki Toda, Keiichi Tokuda, The Blizzard Challenge 2007—Bonn, Germany,Aug. 25, 2007.
Text analysis and language identification for polyglot text-to-speech synthesis, Harald Romsdorfer , Beat Pfister, Received Sep. 14, 2006; received in revised form Apr. 4, 2007; accepted Apr. 13, 2007.
HMM-based Mixed-language (Mandarin-English) Speech Synthesis, Yao Qian, Houwei Cao, Frank K. Soong, 2008 IEEE.
Prosody Modification on Mixed-Language Speech Synthesis, Yi Zhang, Jianhua Tao, 2008 IEEE.
Polyglot Text-to-Speech Synthesis Text Analysis & Prosody Control, Harald Romsdorfer Dipl. Ing., 2009.
Polyglot Speech Prosody Control, Harald Romsdorfer, Sep. 6-10, Brighton UK, 2009.
Taiwan Patent Office, Office Action, Patent Application Serial No. TW099146948, May 8, 2013, Taiwan.
China Patent Office, Office Action, Patent Application Serial No. CN201110034695.1, Mar. 12, 2013, China.

* cited by examiner

300

| L2-To-L1 Phonetic Unit Transformation Table | | | | | | | |
|---|---|---|---|---|---|---|---|
| Inputted Text | English Phonetic Unit Transcription | Mandarin Phonetic Unit Transcription | Probability | Transformation Combination | | | |
| SARS | sa:rs | sa si | 0.8 | s→s | a:r→a | s→si | |
| | | sa er si | 0.2 | s→s | a→a | r→er | s→si |

FIG. 3

MULTI-LINGUAL TEXT-TO-SPEECH SYSTEM AND METHOD

CROSS-REFERENCE TO RELATED APPLICATION

The present application is based on, and claims priorities from, Taiwan Patent Application No. 99146948, filed Dec. 30, 2010, and China Patent Application No. 201110034695.1, filed Jan. 30, 2010, the disclosure of which is hereby incorporated by reference herein in its entirety.

TECHNICAL FIELD

The disclosure generally relates to a multi-lingual text-to-speech (TTS) system and method.

BACKGROUND

The use of multiple languages in an article or a sentence is not uncommon, for example, the use of both English and Mandarin in text. When people need to transform the multi-lingual text into speech via synthesis, taking the contextual scenario into account is important when deciding how to process the text of non-native language. For example, in some scenario, the use of the non-native language with a slight hint of native language accent would sound more natural, such as, the multi-lingual sentences in e-books or e-mails to friends. The current multi-lingual text-to-speech (TTS) systems often use a plurality of synthesizers to switch for different languages; hence, the synthesized speech often includes speeches spoken by different people when multi-lingual text appears, and suffers the problem of interrupted prosody of speech.

Several documents have been disclosed on the subject of multi-lingual TTS. For example, U.S. Pat. No. 6,141,642 disclosed a TTS apparatus and method for processing multiple languages, by switching between multiple synthesizers for multi-lingual text.

Some patents disclosed techniques of mapping non-native language phonetics directly to native language phonetics without considering the difference of the acoustic-prosodic models between different languages. Some patents disclosed techniques of merging similar parts of acoustic-prosodic models of different languages and keeping the different parts without considering the weight of accents. Some papers disclosed techniques of, such as, HMM-based mixed-language, e.g., Mandarin-English, speech synthesizer also without considering accents.

A paper titled "Foreign Accents in Synthetic speech: Development and Evaluation" uses different phonetic mapping to handle the accent issue. Two other papers, "Polyglot speech prosody control" and "Prosody modification on mixed-language speech synthesis" handles the prosody issue, but not the acoustic-prosodic model issue. The paper, "New approach to the polyglot speech generation by means of an HMM-based speaker adaptable synthesizer" uses acoustic-prosodic model adaption to construct non-native language acoustic-prosodic model, but not discloses the manner to control the weight of accent.

SUMMARY

The exemplary embodiments may provide a multi-lingual text-to-speech system and method.

A disclosed exemplary embodiment relates to a multi-lingual text-to-speech system. The system comprises an acoustic-prosodic model selection module, an acoustic-prosodic model mergence module, and a speech synthesizer. For an inputted text to be synthesized and containing a second-language (L2) portion, and an L2 phonetic unit transcription corresponding to the L2 portion of the inputted text, the acoustic-prosodic model selection module sequentially finds a second acoustic-prosodic model corresponding to each phonetic unit of the L2 phonetic unit transcription in an L2 acoustic-prosodic model set, searches a phonetic unit transformation table from the L2 to a first-language (L1), and uses at least a controllable accent weighting parameter to determine a transformation combination to select a corresponding L1 phonetic unit transcription and sequentially find a first acoustic-prosodic model corresponding to each phonetic unit of the L1 phonetic unit transcription in an L1 acoustic-prosodic model set. The acoustic-prosodic model mergence module combines the first and the second acoustic-prosodic models into a merged acoustic-prosodic model according to the at least a controllable accent weighting parameter, sequentially processes all the transformations in the transformation combination, then sequentially arranges each merged acoustic-prosodic model to generate a merged acoustic-prosodic model sequence. The merged acoustic-prosodic model sequence is then applied to the speech synthesizer to synthesize the inputted text into an L2 speech with an L1 accent, that is, an L1-accent L2 speech.

Another disclosed exemplary embodiment relates to a multi-lingual text-to-speech system. The system is executed in a computer system. The computer system includes a memory device for storing a plurality of language acoustic-prosodic model set, including at least a first and a second language acoustic-prosodic model sets. The multi-lingual text-to-speech system may include a processor, and the processor further includes an acoustic-prosodic model selection module, an acoustic-prosodic model mergence module and a speech synthesizer. In an offline phase, a phonetic unit transformation table is constructed for the use by the processor. For an inputted text to be synthesized and containing a second-language (L2) portion, and an L2 phonetic unit transcription corresponding to the L2 portion of the inputted text, the acoustic-prosodic model selection module sequentially finds a second acoustic-prosodic model corresponding to each phonetic unit of the L2 phonetic unit transcription in the L2 acoustic-prosodic model set, searches a phonetic unit transformation table from the L2 to the first-language (L1), and uses at least a controllable accent weighting parameter to determine a transformation combination to select a corresponding L1 phonetic unit transcription and sequentially find a first acoustic-prosodic model corresponding to each phonetic unit of the L1 phonetic unit transcription in the L1 acoustic-prosodic model set. The acoustic-prosodic model mergence module combines the first and the second acoustic-prosodic models found by the acoustic-prosodic model selection module into a merged acoustic-prosodic model according to the at least a controllable accent weighting parameter, sequentially processes all the transformations in the transformation combination, then sequentially arranges each merged acoustic-prosodic model to generate a merged acoustic-prosodic model sequence. The merged acoustic-prosodic model sequence is then applied to the speech synthesizer to synthesize the inputted text into an L2 speech with an L1 accent, that is, an L1-accent L2 speech.

Yet another disclosed exemplary embodiment relates to a multi-lingual text-to-speech method. The method is executed in a computer system. The computer system includes a memory device for storing a plurality of language acoustic-prosodic model sets, including at least a first and a second language acoustic-prosodic model sets. The method comprises: for an inputted text to be synthesized and containing a second-language (L2) portion, and an L2 phonetic unit transcription corresponding to the L2 portion of the inputted text, sequentially, finding the second acoustic-prosodic model corresponding to each phonetic unit of the L2 phonetic unit transcription in the L2 acoustic-prosodic model set, searching a phonetic unit transformation table from the L2 to a first-language (L1), and using at least a controllable accent weighting parameter to determine a transformation combination to select a corresponding L1 phonetic unit transcription and sequentially find a first acoustic-prosodic model corresponding to each phonetic unit of the L1 phonetic unit transcription in the L1 acoustic-prosodic model set; combining the first and the second acoustic-prosodic models into a merged acoustic-prosodic model according to the at least a controllable accent weighting parameter, sequentially processing all the transformations in the transformation combination, then sequentially arranging each merged acoustic-prosodic model to generate a merged acoustic-prosodic model sequence; and applying the merged acoustic-prosodic model sequence to a speech synthesizer to synthesize the inputted text into an L2 speech with an L1 accent, that is, an L1-accent L2 speech.

The foregoing and other features, aspects and advantages of the present invention will become better understood from a careful reading of a detailed description provided herein below with appropriate reference to the accompanying drawings.

BRIEF DESCRIPTION OF THE DRAWINGS

FIG. 3 shows an exemplar of L2-to-L1 phonetic unit transformation table, according to an exemplary embodiment.

DETAILED DESCRIPTION OF DISCLOSED EMBODIMENTS

Figure 1:
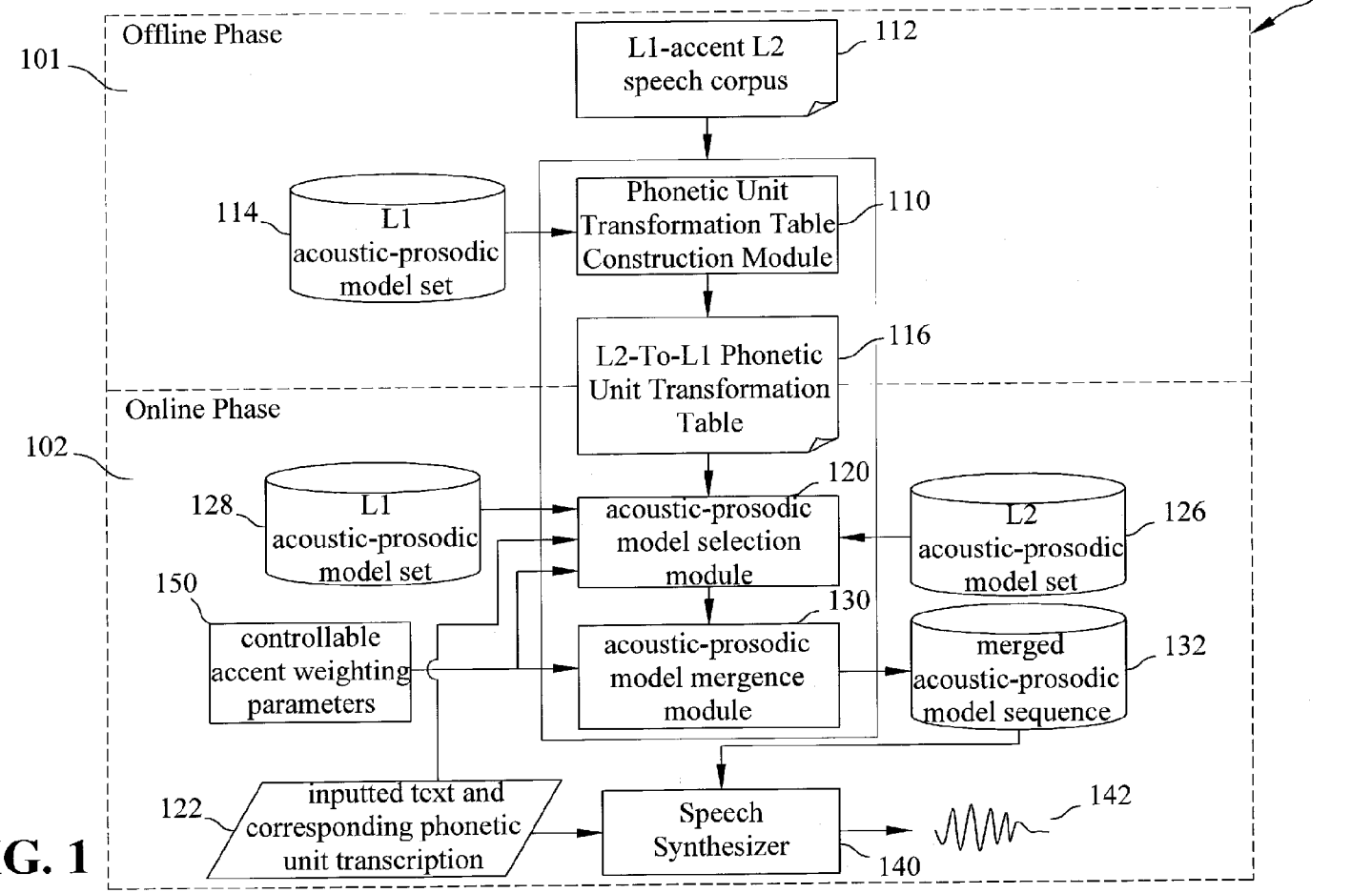
FIG. 1 shows an exemplary schematic view of a multi-lingual text-to-speech system, according to an exemplary embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The exemplary embodiments of the present disclosure provide a multi-lingual text-to-speech speech technology with a control mechanism to adjust the accent weight of a native language while synthesizing a non-native language text. Thereby, the speech synthesizer may determine how to process the non-native language text in a multi-lingual context. In this manner, the synthesized speech may have a more natural prosody and the pronunciation accent would match the contextual scenario. In other words, the exemplary embodiments transform the non-native language (i.e., second-language, L2) text into an L2 speech with a first-language (L1) accent.

The exemplary embodiments use the parameters to control the mapping of phonetic unit transcription and the merging of acoustic-prosodic models to vary the pronunciation and the prosody of the synthesized L2 speech within two extremes, the standard L2 style and the complete L1 style. The exemplary embodiments may adjust the accent weighting of the prosody and pronunciation in the synthesized multi-lingual speech as preferred.

FIG. 1 shows an exemplary schematic view of a multi-lingual text-to-speech system, consistent with certain disclosed embodiments. In FIG. 1, a multi-lingual text-to-speech system 100 comprises an acoustic-prosodic model selection module 120, an acoustic-prosodic model mergence module 130 and a speech synthesizer 140. In an online phase 102, an acoustic-prosodic model selection module 120 uses an inputted text and corresponding phonetic unit transcription 122 to sequentially find out a second acoustic-prosodic model from an L2 acoustic-prosodic model set 126, where each model corresponds to each phonetic unit of the L2 phonetic unit transcription. Then, the acoustic-prosodic model selection module 120 looks up the inputted text from an L2-to-L1 phonetic unit transformation table 116, and uses one or more controllable accent weighting parameters 150 to determine a transformation combination and corresponding L1 phonetic unit transcription, and sequentially finds out a first acoustic-prosodic model corresponding to each phonetic unit of the L1 phonetic unit transcription from an L1 acoustic-prosodic model set 128.

Acoustic-prosodic model mergence module 130 merges the first and the second acoustic-prosodic models, which are found in L1 acoustic-prosodic model set 128 and L2 acoustic-prosodic model set 126 by the acoustic-prosodic model selection module 120 as previously described, into a merged acoustic-prosodic model according to the one or more controllable accent weighting parameters 150 and the transformation combination determined by the acoustic-prosodic model selection module 120. Then, the acoustic-prosodic model mergence module 130 sequentially processes all the transformations in the transformation combination, and sequentially aligns each merged acoustic-prosodic model to form a merged acoustic-prosodic model sequence 132. The merged acoustic-prosodic model sequence 132 is then applied to the speech synthesizer 140 to synthesize the inputted text into an L1-accent L2 speech.

The multi-lingual text-to-speech system may further include a phonetic unit transformation table construction module 110, to generate the L2-to-L1 phonetic transformation table 116 by using an L1-accent L2 speech corpus 112 and an L1 acoustic-prosodic model set 114 in an offline phase 101.

In the above description, the L1 acoustic-prosodic model set 114 is for phonetic unit transformation table construction module 110, and L1 acoustic-prosodic model set 128 is for the acoustic-prosodic model mergence module 130. Two acoustic-prosodic model sets 114, 128 may employ the same feature parameters or different feature parameters. However, L2 acoustic-prosodic model set 126 and L1 acoustic-prosodic model set 128 employ the same feature parameters.

Inputted text and corresponding phonetic unit transcription 122 to be synthesized may include both L1 and L2 text, such as, Mandarin-English-mixed sentence. For example, ta jin tian gan jue hen "high", "Cindy" zuo tian "mail" gei wo, zhe jian yi fu shi "M" hao de, wherein the words "high", "Cindy", "mail" and "M" are in English while the rest of the words are in Mandarin. In this case, L1 is Mandarin and L2 is English. The L1 part of the synthesized speech remains the standard pronunciation and the L2 part is synthesized as L1-accent L2 speech. Inputted text and corresponding phonetic unit transcription 122 may also include L2 part only, such as, the Mandarin to be synthesized with Taiwanese accent. In this case, L1 is Taiwanese and L2 is Mandarin. In other words, inputted text to be synthesized at least includes L2 text, and the phonetic unit transcription corresponding to the inputted text includes at least an L2 phonetic unit transcription.

Figure 2:
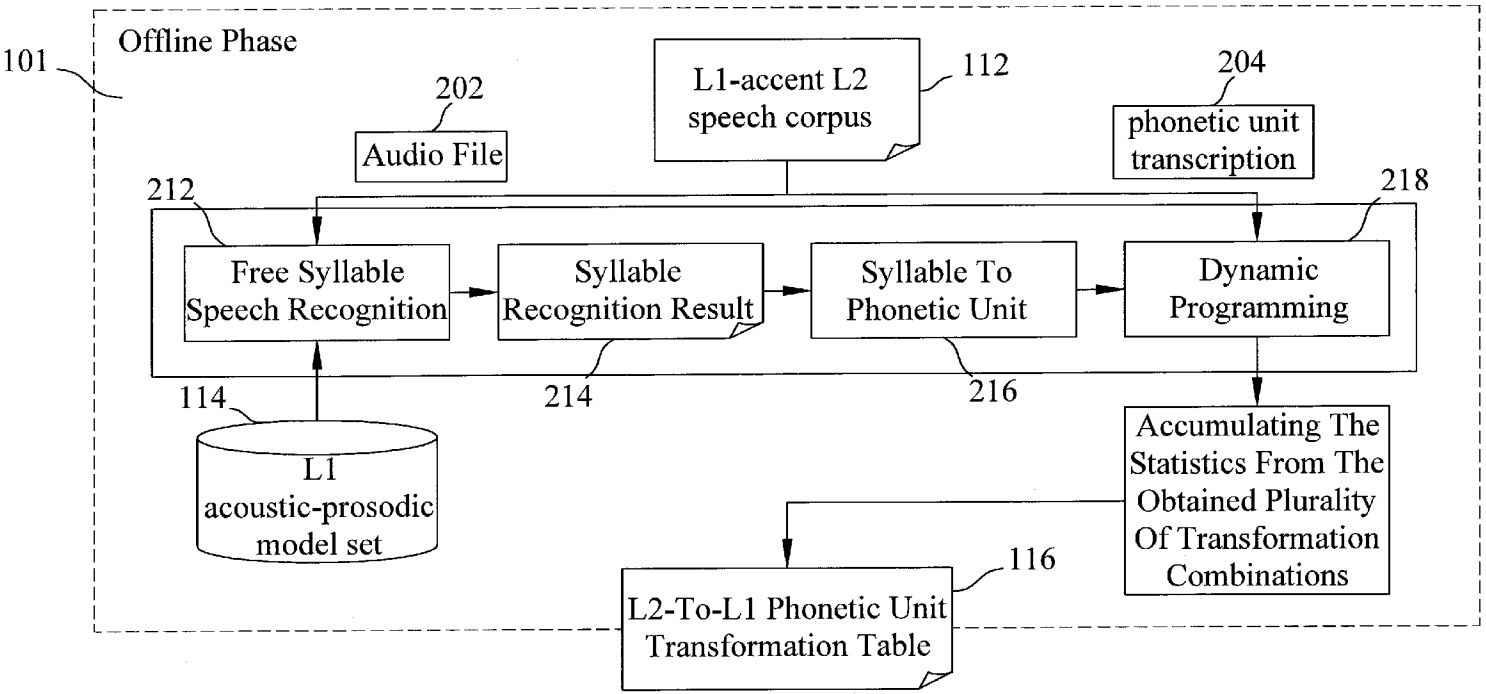
FIG. 2 shows an exemplary schematic view of how a phonetic unit transformation table construction module constructing a phonetic unit transformation table, according to an exemplary embodiment.

FIG. 2 shows an exemplary schematic view of how a phonetic unit transformation table construction module 110 constructing a phonetic unit transformation table, consistent with certain disclosed embodiments. In the offline phase, as shown in FIG. 2, the steps of constructing an L2-to-L1 phonetic transformation table may include: (1) preparing an L1-accent L2 speech corpus 112 which having a plurality of audio files 202 and a plurality of phonetic unit transcription 204 corresponding to audio files 202; (2) selecting an audio file and a corresponding L2 phonetic unit transcription from L1-accent L2 speech corpus 112, performing free syllable speech recognition 212 on the audio file with the L1 acoustic-prosodic model set 114, to generate syllable recognition result 214; performing free tone recognition for the pitch to generate a free pitch recognition result 214, at this point, the result being tonal syllable; (3) syllable-to-speech unit 216 converting the syllable recognition result 214 into an L1 phonetic unit transcription; and (4) using dynamic programming (DP) 218 to perform phonetic unit alignment on L2 phonetic unit transcription of step (2) and L1 phonetic unit transcription converted by step (3) to obtain a transformation combination. In other words, DP is used to find the phonetic unit correspondence and the transformation type for the L2 phonetic unit transcription and the L1 phonetic unit transcription.

A plurality of transformation combinations may be obtained by repeating the above steps (2), (3), (4). L2-to-L1 phonetic unit transformation table 116 may be accomplished by accumulating the statistics from the obtained plurality of transformation combinations. The phonetic unit transformation table may contain three types of transformations, i.e. substitution, insertion and deletion, wherein substitution is an one-to-one transformation, insertion is an one-to-many transformation and deletion is a many-to-one transformation.

For example, an audio file recording "SARS" is in a L1-accent (Mandarin) L2 (English) speech corpus 112, where the corresponding L2 phonetic unit transcription is /sa:rs/ (using International Phonetic Alphabet (IPA) representation). Apply free syllable speech recognition 212 with the L1 acoustic-prosodic model set 114 on the audio file to generate the syllable recognition result 214. After syllable-to-speech unit 216 processing, L1 (Mandarin) phonetic unit transcription is, such as, /sa si/ (using HanYu PinYin phonetic representation). After performing DP alignment 218 on L2 phonetic unit transcription /sa:rs/ and L1 phonetic unit transcription /sa si/, for example, a transformation combination, including a substitution of s→s, a deletion of a:r→a, and an insertion of s→si, is found.

The example of DP alignment 218 is described as follows. For example, a five-state Hidden Markov Model (HMM) is used to describe an acoustic-prosodic model. The feature parameters of each state is assumed as Mel-Cepstrum and the dimension is 25, the distribution of each dimension of the feature parameters is a single Gaussian distribution, expressed as a Gaussian density function $g(\mu(\Sigma)$, wherein $\mu$ is the average vector (with dimension 25×1), $\Sigma$ is the co-variance matrix (with dimension 25×25), those belonging to the first acoustic-prosodic model of L1 are expressed as $g_1(\mu_1, \Sigma_1)$, and those belonging to the second acoustic-prosodic model of L2 are expressed as $g_2(\mu_2, \Sigma_2)$. During the DP process, a Bhattacharyya distance (used in statistics to compute the distance between two discrete probability distributions) may be used to compute the local distance between the two acoustic-prosodic models as the local distance in the DP process. Bhattacharyya distance b is expressed as equation (1):

$$b = \frac{1}{8}(\mu_2 - \mu_1)^T \left[\frac{\sum_1 + \sum_2}{2}\right]^{-1} (\mu_2 - \mu_1) + \frac{1}{2}\ln\frac{\left|\left(\sum_1 + \sum_2\right)/2\right|}{|\sum_1|^{1/2}|\sum_2|^{1/2}} \tag{1}$$

The distance between the i-th state ($1 \le i \le 5$) of the first acoustic-prosodic model and the i-th state of the second acoustic-prosodic model may be computed following the above equation. For example, the local distance of the aforementioned 5-state HMM may be obtained by summing the Bhattacharyya distances of the five states. In the aforementioned SARS example, FIG. 5 further explains the details of DP 218, wherein X-axis is the L1 phonetic unit transcription and Y-axis is the L2 phonetic unit transcription.

Figure 5:
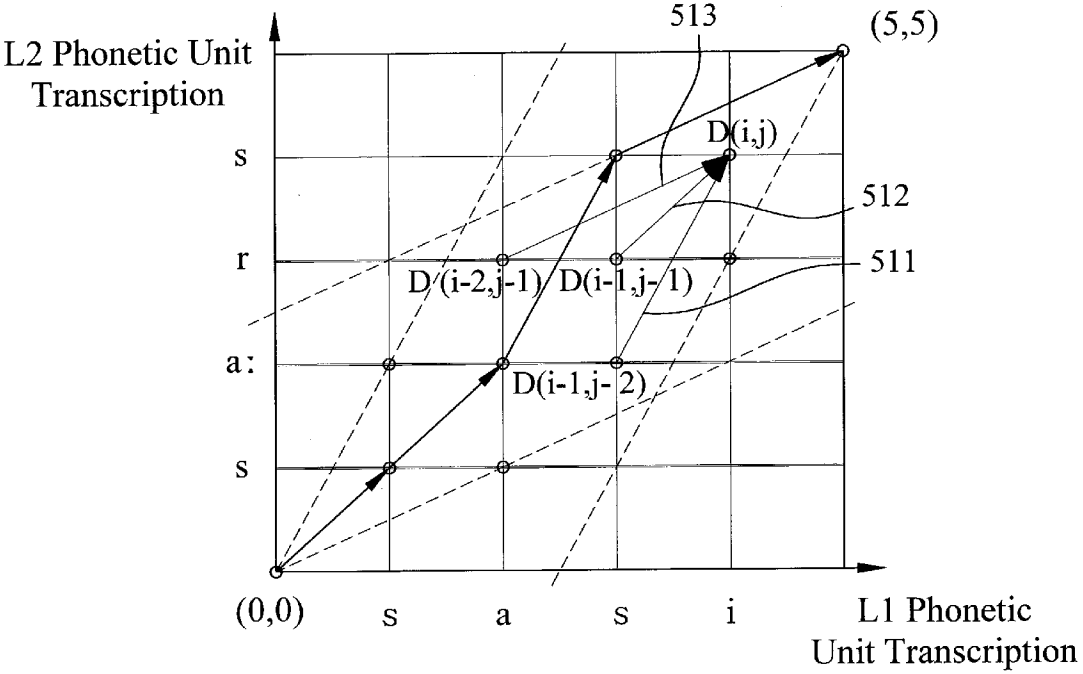
FIG. 5 shows an exemplary schematic view of the details of dynamic programming, according to an exemplary embodiment.

In FIG. 5, the shortest path from origin (0,0) to final (5,5) may be found by DP, thus, the phonetic unit correspondence and the transformation type for the transformation combination of the L1 phonetic unit transcription and the L2 phonetic unit transcription are found. The way to find the shortest path is to find the path having the minimum accumulated distance. Accumulated distance D(i,j) is the total distance accumulated from origin (0,0) to point (i,j), where i is the X coordinate and j is the Y coordinate. D(i,j) can be computed by the following equation:

$$D(i, j) = b(i, j) + \min\begin{Bmatrix} \omega_1 \cdot D(i-2, j-1) \\ \omega_2 \cdot D(i-1, j-1) \\ \omega_3 \cdot D(i-1, j-2) \end{Bmatrix},$$

where b(i,j) is the local distance of the two acoustic-prosodic models of point (i,j). At the origin (0,0), D(0,0)=b(0,0). The disclosed exemplary embodiments use Bhattacharyya distance as the local distance, and $\omega_1$, $\omega_2$ and $\omega_3$ are the weight of insertion, substitution and deletion, respectively. The weight may be used to control the effects of the substitution, insertion and deletion on the accumulated distance. A larger $\omega$ means a stronger effect on the accumulated distance.

In FIG. 5, lines 511-513 show that point (i,j) can only be reached through these three paths, and the other paths are prohibited; that is, a certain point only has three paths to move to the next point. This means that only substitution (path 512), deletion of a phonetic unit (path 511) and insertion of a phonetic unit (path 513) are allowed. Therefore, there are only three allowable transformation types. Because of this constrain, in DP process, there are four dash lines forming a global constraint. Because all the other paths exceeding the dash lines enclosed area cannot reach the end, a shortest path can be found by computing all the points within the area constrained by the four dash lines. First, the local distance of each point is computed for all points within the global constrain area. Then, the accumulated distance of all the possible paths from (0,0) to (5,5) are computed to find the minimum value. The present example assumes that the shortest path is the path connected by the arrow headed solid lines.

The following describes phonetic unit transformation table. L2-to-L1 transformation table is as shown in FIG. 3. Assume that L1-accent (Mandarin) L2 (English) speech corpus 112 contains ten audio files recording "SARS". Repeat the above speech recognition, syllable to phonetic unit, and DP steps. Assuming that eight of them get transformation combinations as the same as the previous result (s→s, a:r→a, s→si), and the other two get transformation combinations as s→s, a:→a, r→er, s→si. Then, accumulate all the transformation combinations and generated a statistical list, i.e. the L2-to-L1 phonetic unit transformation table 300. In FIG. 3, L2 (English) to L1 (Mandarin) phonetic unit transformation table 300 contains two transformation combinations, with probabilities 0.8 and 0.2, respectively.

Figure 4:
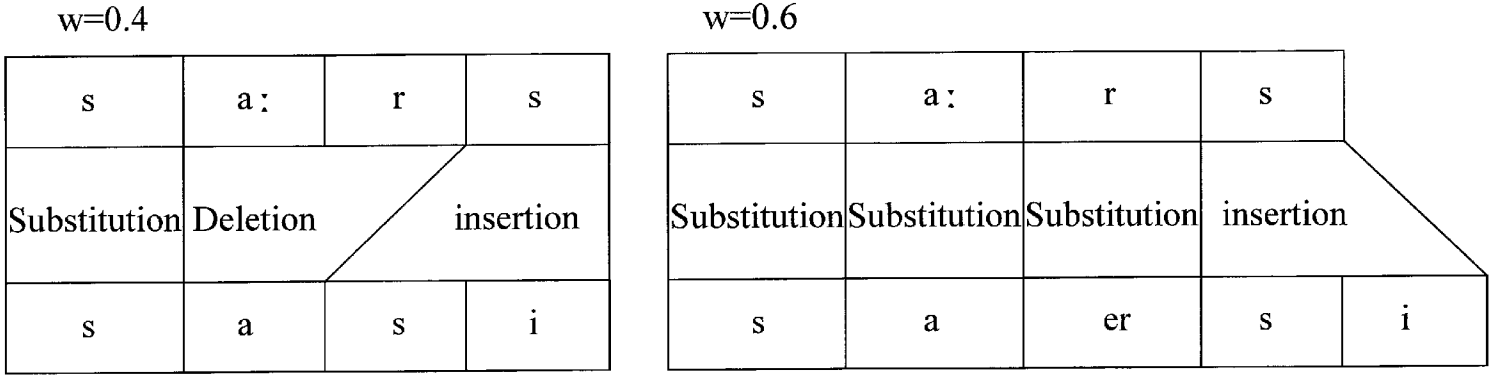
FIG. 4 shows an exemplary schematic view of selecting transformation combination in the L2-to-L1 phonetic unit transformation table based on set controllable accent weighting parameter, according to an exemplary embodiment.

The following describes the operations of the acoustic-prosodic model selection module, acoustic-prosodic model mergence module and speech synthesizer in online phase 102. According to the set controllable accent weighting parameters 150, the acoustic-prosodic model selection module selects transformation combinations from phonetic unit transformation table to control the influence of L1 on L2. For example, when the controllable accent weighting parameters are set lower, the accent is lighter. Therefore, the transformation combination with the higher probability is selected to indicate that the selected accent is more likely to appear and easier for the public to recognize. On the other hand, when the controllable accent weighting parameters are set higher, the accent is heavier. Therefore, the transformation combination with the lower probability is selected to indicate that the selected accent is less likely to appear and harder for the public to recognize. For example, FIG. 4 illustrates the selecting transformation combination in the L2-to-L1 phonetic unit transformation table based on a set controllable accent weighting parameter. Assume that 0.5 is used as a threshold. When the set controllable accent weighting parameter w=0.4 (w<0.5), the transformation combination with probability 0.8 in L2-to-L1 phonetic unit transformation table 300 is selected; when the set controllable accent weighting parameter w=0.6 (w>0.5), the transformation combination with probability 0.2 in L2-to-L1 phonetic unit transformation table 300 is selected.

Figure 6:
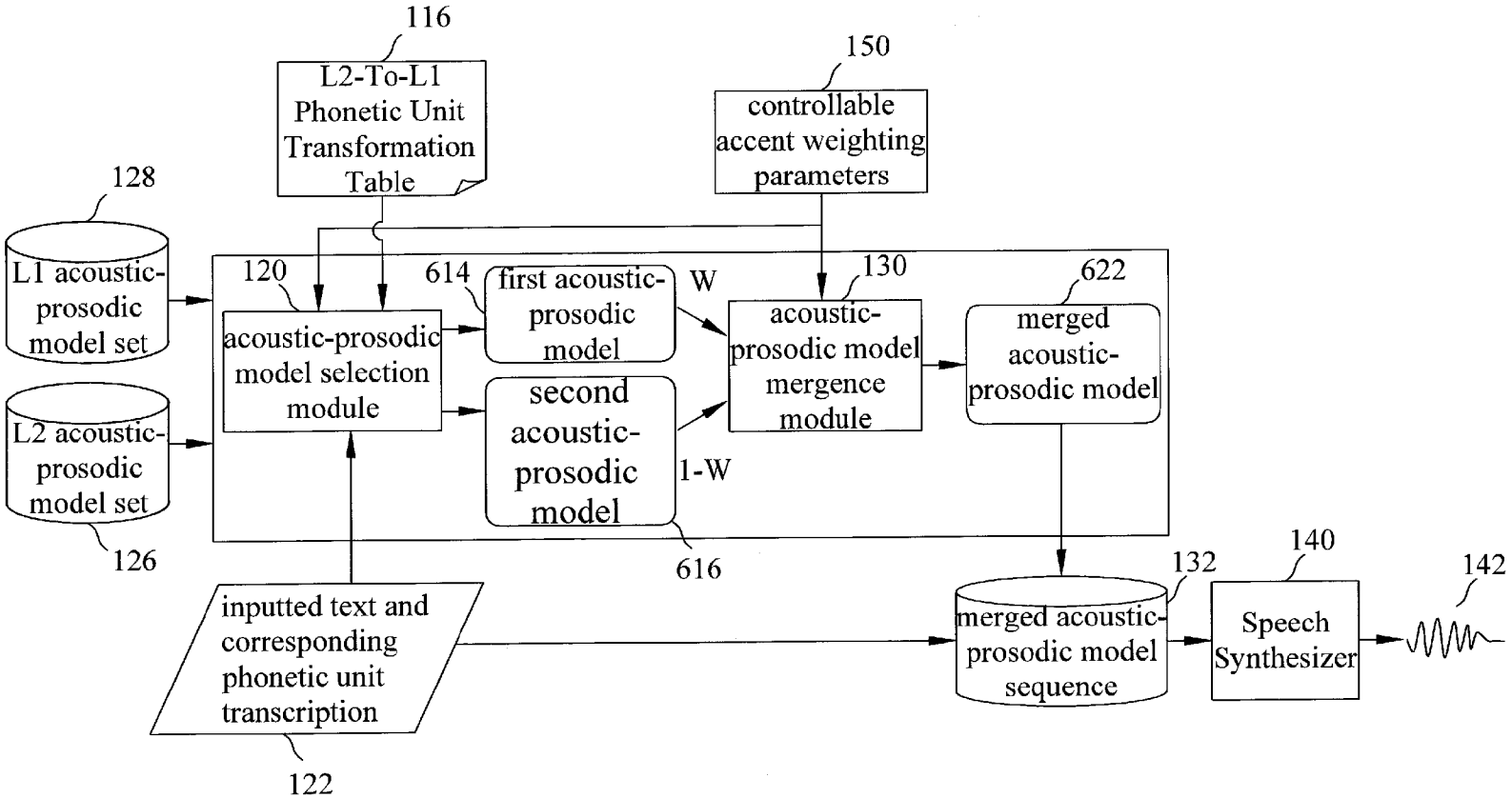
FIG. 6 shows an exemplary schematic view of the operations of each module in an online phase, according to an exemplary embodiment.

Refer to the exemplary operation of FIG. 6. Based on an inputted text, at least including L2, and corresponding phonetic unit transcription 122 corresponding to the inputted text, acoustic-prosodic model selection module 120 uses L2-to-L1 phonetic unit transformation table 116 and sets the controllable accent weighting parameters 150 to perform model selection. Model selection includes sequentially finding a corresponding acoustic-prosodic model for each phonetic unit in L2 acoustic-prosodic model set 126, searching L2-to-L1 phonetic unit transformation table 116 and selecting the transformation combination according to the controllable accent weighting parameters 150, and determining the corresponding L1 phonetic unit transcription and sequentially finding a corresponding acoustic-prosodic model for each phonetic unit in L1 acoustic-prosodic model set 128 for each phonetic unit of the L1 phonetic unit transcription. Assume that each acoustic-prosodic model is the 5-state HMM, as aforementioned. For example, the probability distribution in each dimension of the Mel-Cepstrum in i-th state ($1 \le i \le 5$) of the first acoustic-prosodic model 614 is represented by a single Gaussian distribution, $g_1(\mu_1, \Sigma_1)$, and the same of the second acoustic-prosodic model 616 is represented by $g_2(\mu_2, \Sigma_2)$. Acoustic-prosodic model mergence model 130 may use the following equation (2) to merge the first acoustic-prosodic model 614 and the second acoustic-prosodic model 616 into a merged acoustic-prosodic model 622. The i-th state of the merged acoustic-prosodic model has a Mel-Cepstrum that in each dimension the probability distribution is $g_{new}(\mu_{new}, \Sigma_{new})$, and let $$\mu_{new} = w^*\mu_1 + (1-w)^*\mu_2$$

$$\Sigma_{new} = w^*(\Sigma_1 + (\mu_1 - \mu_{new})^2) + (1-w)^*(\Sigma_2 + (\mu_2 - \mu_{new})^2) \quad (2)$$

where w is the controllable accent weighting parameter 150, and $0 \le w \le 1$. The physical meaning of equation (2) is that the two Gaussian density functions are merged by linear interpolation With the 5-state HMM, the merged acoustic-prosodic model 622 may be obtained after computing the $g_{new}(\mu_{new}, \Sigma_{new})$ in each dimension of the Mel-Cepstrum in each state individually. For example, for the s→s substitution, a merged acoustic-prosodic model is obtained by using equation (2) to merge the first acoustic-prosodic model(s) and the second acoustic-prosodic model(s). The deletion transformation of a:r→a is accomplished via a:→a, and r→silence, respectively. Similarly, the insertion transformation of s→si is accomplished via s→s and silence→i, respectively. In other words, when the transformation is substitution, the first acoustic-prosodic model corresponding to the second acoustic-prosodic model is used. When the transformation is insertion or deletion, the silence model is used as a corresponding model. After processing all transformations in the transformation combination, a merged acoustic-prosodic model sequence 132 may be obtained via sequentially arranging each merged acoustic-prosodic model 622. Merged acoustic-prosodic model sequence 132 is further provided to speech synthesizer 140 to be synthesized as an L1-accent L2 speech 142.

The above example explains the acoustics parameter mergence of HMM. The merged prosody parameters, i.e., duration and pitch, may also be obtained via equation (2). For the duration mergence, the merged duration model of each phonetic unit may be obtained from L1 and L2 acoustic-prosodic models by applying equation (2), where the silence model corresponding to insertion/deletion has the duration of zero. For pitch parameter mergence, the substitution transformation may also follow equation (2). The deletion transformation may directly use the pitch parameter of the original phonetic unit, such as, a:r→a deletion, let r keep original pitch parameter. The insertion transformation may use equation (2) to merge the pitch model of the inserted phonetic unit with the pitch parameter of the nearest voiced phonetic unit in L2. For example, insertion transformation of s→si may use the pitch parameter of the phonetic unit i and the pitch parameter of the voiced phonetic unit a: in the combination (because s is a voiceless phonetic unit and the pitch value of voiceless phonetic unit is not available.)

In other words, acoustic-prosodic model mergence module 130 merges the acoustic-prosodic models corresponding to each L2 phonetic unit in the L2 phonetic unit transcription with the acoustic-prosodic models corresponding to each L1 phonetic unit in the L1 phonetic unit transcription into a merged acoustic-prosodic model according to set controllable accent weighting parameters and the selected corresponding transformation combination, and sequentially arranges each merged acoustic-prosodic model to obtain a merged acoustic-prosodic model sequence.

Figure 7:
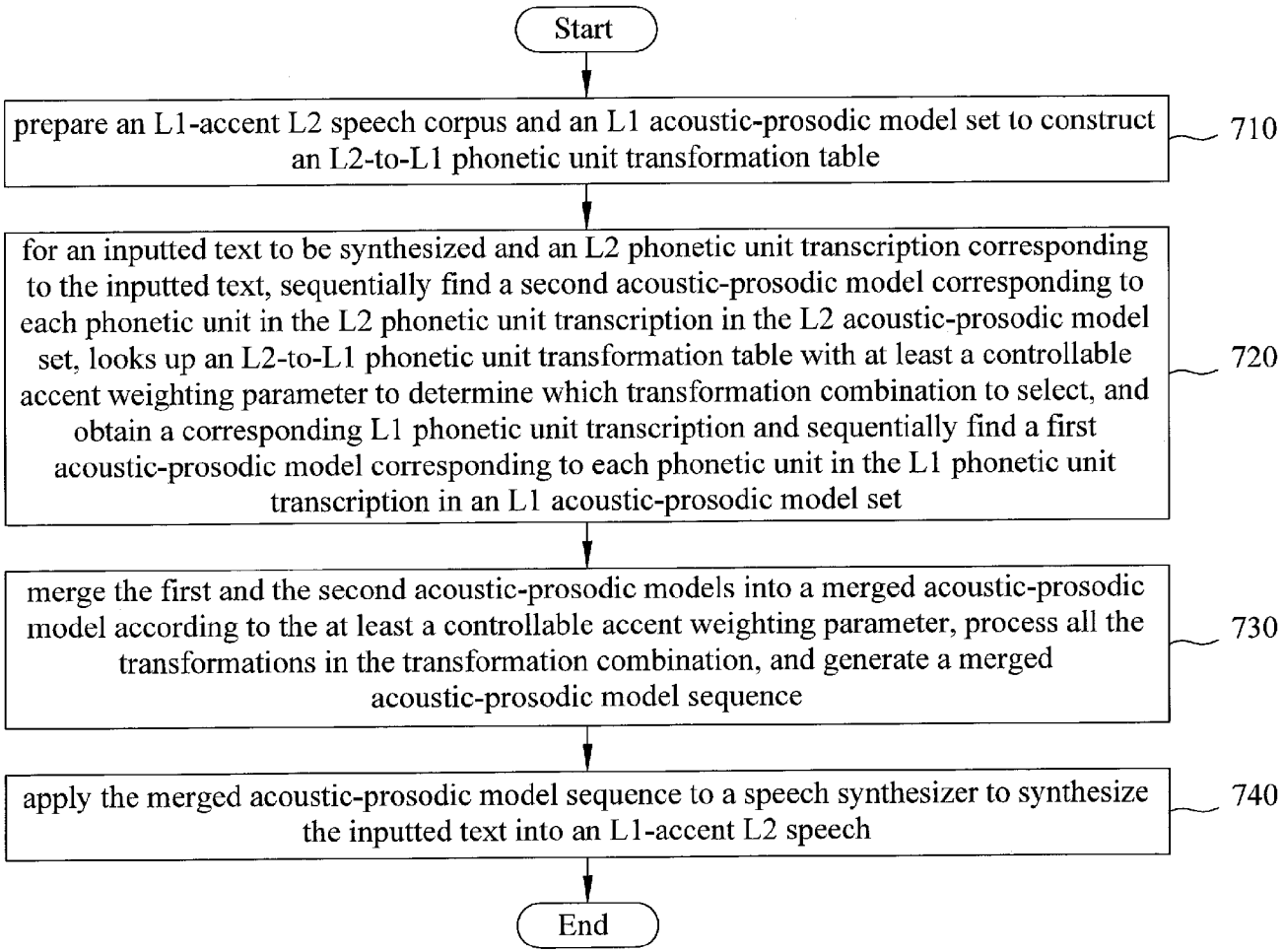
FIG. 7 shows an exemplary flowchart illustrating a multi-lingual text-to-speech method, according to an exemplary embodiment.

FIG. 7 shows an exemplary flowchart illustrating a multi-lingual text-to-speech method, consistent with certain disclosed embodiments. The method is executed on a computer system. The computer system has a memory device for storing a plurality of acoustic-prosodic model sets of multiple languages, including at least L1 and L2 acoustic-prosodic model sets. In FIG. 7, first, an L1-accent L2 speech corpus and an L1 acoustic-prosodic model set are prepared to construct an L2-to-L1 phonetic unit transformation table, as shown in step 710. Then, in step 720, for an inputted text to be synthesized and an L2 phonetic unit transcription corresponding to the inputted text, the method sequentially finds a second acoustic-prosodic model corresponding to each phonetic unit in the L2 phonetic unit transcription in the L2 acoustic-prosodic model set, looks up an L2-to-L1 phonetic unit transformation table with at least a controllable accent weighting parameter to determine which transformation combination to select, and obtains a corresponding L1 phonetic unit transcription and sequentially finds a first acoustic-prosodic model corresponding to each phonetic unit in the L1 phonetic unit transcription in an L1 acoustic-prosodic model set. In Step 730, it is to merge the found first and the second acoustic-prosodic models into a merged acoustic-prosodic model according to the at least a controllable accent weighting parameter, process all the transformations in the transformation combination, and generate a merged acoustic-prosodic model sequence. Finally, the merged acoustic-prosodic model sequence is applied to a speech synthesizer to synthesize the inputted text into an L1-accent L2 speech, as shown in step 740.

The above method may be simplified to include only steps 720-740. The L2-to-L1 phonetic unit transformation table may be constructed in an offline phase, and may be constructed by other methods. The method of the exemplary embodiment may then consult a constructed L2-to-L1 phonetic unit transformation table in an online phase.

The details of each step, for example, constructing an L2-to-L1 phonetic unit transformation table shown in step 710, determining the transformation combination according to the controllable accent weighting parameters and finding two acoustic-prosodic models shown in step 720, and merging two acoustic-prosodic models into a merged acoustic-prosodic model according to the controllable accent weighting parameters shown in step 730, are all identical to the earlier description, thus are omitted here.

Figure 8:
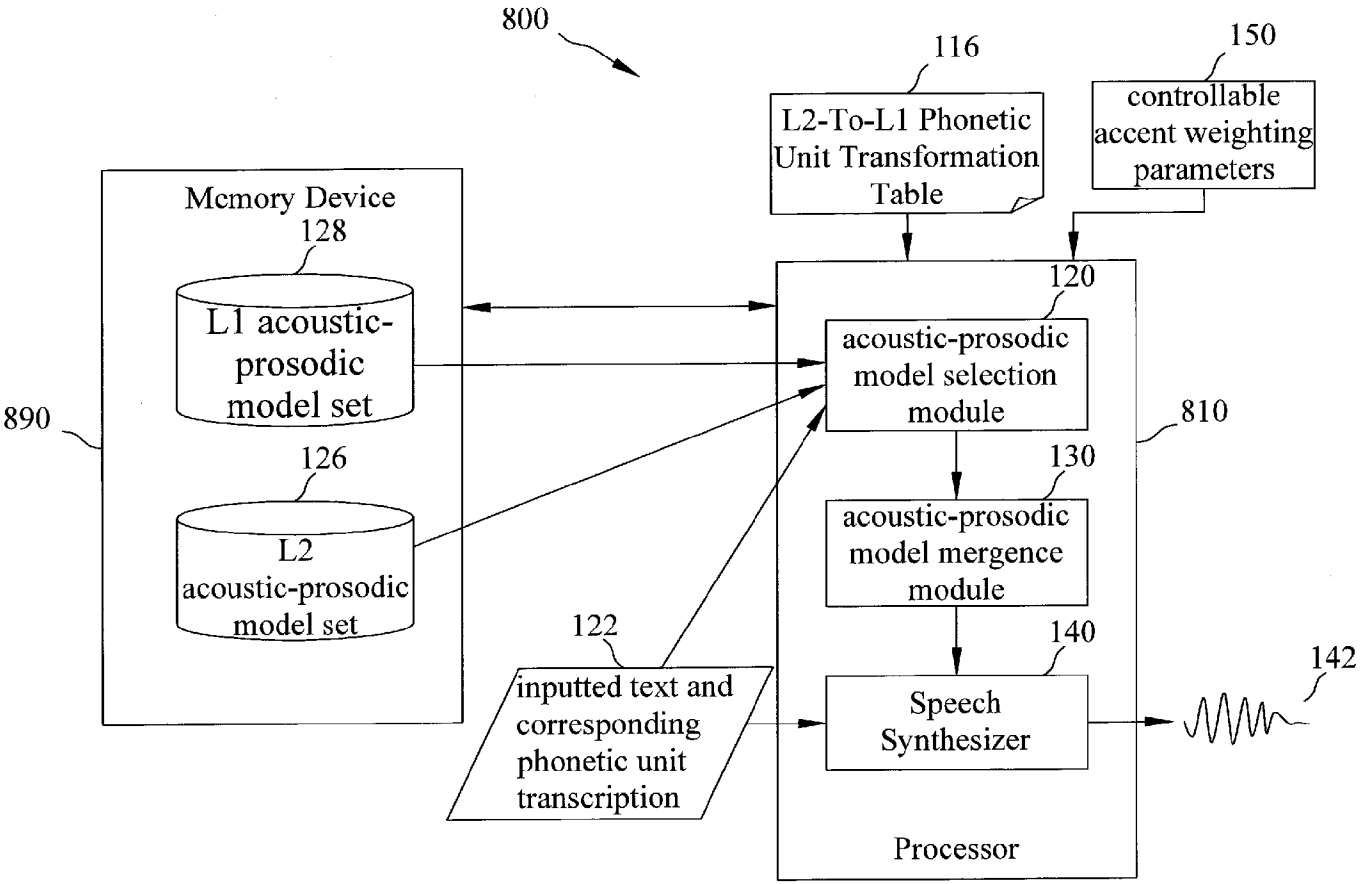
FIG. 8 shows an exemplary schematic view of executing the multi-lingual text-to-speech system on a computer system, according to an exemplary embodiment.

The disclosed multi-lingual text-to-speech system of the exemplary embodiment may also be executed on a computer system, as shown in FIG. 8. The computer system (not shown) includes a memory device 890 for storing a plurality of acoustic-prosodic model sets of multiple languages, including at least L1 acoustic-prosodic model set 128 and L2 acoustic-prosodic model set 126. Multi-lingual text-to-speech synthesis system 800 may further include a processor 810. Processor 810 may further include acoustic-prosodic model selection module 120, acoustic-prosodic model mergence module 130 and speech synthesizer 140 to execute the aforementioned functions of the modules. In an offline phase, a phonetic unit transformation table is constructed and a controllable accent weighting parameter is set for the use by acoustic-prosodic model selection module 120 and acoustic-prosodic model mergence module 130. The operations are identical to the above description and thus are omitted here. The phonetic unit transformation table may be constructed by this computer or other computer system.

In summary, the disclosed exemplary embodiments provide a multi-lingual text-to-speech system and method, which may use controllable parameters to adjust phonetic unit transformation and acoustic-prosodic model mergence, and allow the pronunciation and prosody of the L2 section in a multi-lingual synthesized speech to be adjusted between native standard pronunciation and completely pronounced in L1 manner. The exemplary embodiments are applicable to such as audio e-book, home robot, digital teaching, so that the multi-lingual characters and scenarios may be vividly expressed. For example, a heavily accent speaker may appear in an audio e-book, a robot may present speech with amusement effects, etc.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A multi-lingual text-to-speech system, comprising:

an acoustic-prosodic model selection module, for an inputted text to be synthesized and containing a second-language (L2) portion, and an L2 phonetic unit transcription corresponding to the L2 portion of the inputted text, sequentially finds a second acoustic-prosodic model corresponding to each phonetic unit of the L2 phonetic unit transcription in an L2 acoustic-prosodic model set, searches an L2-to-L1 phonetic unit transformation table, L1 being a first language, and uses at least a controllable accent weighting parameter to determine a transformation combination to select a corresponding L1 phonetic unit transcription and sequentially find a first acoustic-prosodic model corresponding to each phonetic unit of said L1 phonetic unit transcription in an L1 acoustic-prosodic model set;

an acoustic-prosodic model mergence module that merges said first and said second acoustic-prosodic models into a merged acoustic-prosodic model according to said at least a controllable accent weighting parameter, sequentially processes all the transformations in said transformation combination, then sequentially arranges each merged acoustic-prosodic model to generate a merged acoustic-prosodic model sequence; and a speech synthesizer, wherein said merged acoustic-prosodic model sequence is applied to said speech synthesizer to synthesize said inputted text into an L2 speech with an L1 accent based at least partly on the transformation combination determined by the controllable accent weighting parameter.

2. The system as claimed in claim 1, wherein said L2-to-L1 phonetic unit transformation table is constructed in an offline phase via a phonetic unit transformation table construction module, according to an L1-accent L2 speech corpus and an L1 acoustic-prosodic model set.

3. The system as claimed in claim 1, wherein said acoustic-prosodic model mergence module merges said second acoustic-prosodic model and said first acoustic-prosodic model into said merged acoustic-prosodic model by using a weight computation scheme.

4. The system as claimed in claim 1, wherein said second acoustic-prosodic model and said first acoustic-prosodic model at least comprise an acoustic parameter.

5. The system as claimed in claim 4, wherein said second acoustic-prosodic model and said first acoustic-prosodic model further comprise a duration parameter and a pitch parameter.

6. A multi-lingual text-to-speech system, executed on a computer system, said computer system having a memory device for storing at least a first and a second language acoustic-prosodic model sets, said multi-lingual text-to-speech system comprising:

a processor having an acoustic-prosodic model selection module, an acoustic-prosodic model mergence module and a speech synthesizer, wherein for an inputted text to be synthesized and containing a second-language (L2) portion, and an L2 phonetic unit transcription corresponding to the L2 portion of the inputted text, said acoustic-prosodic model selection module sequentially finds a second acoustic-prosodic model corresponding to each phonetic unit of the L2 phonetic unit transcription in an L2 acoustic-prosodic model set, searches an L2-to-L1 phonetic unit transformation, L1 being a first language, and uses at least a controllable accent weighting parameter to determine a transformation combination to select a corresponding L1 phonetic unit transcription and sequentially find a first acoustic-prosodic model corresponding to each phonetic unit of said L1 phonetic unit transcription in an L1 acoustic-prosodic model set, said acoustic-prosodic model mergence module merges said first and said second acoustic-prosodic models into a merged acoustic-prosodic model according to said at least a controllable accent weighting parameter, sequentially processes all the transformations in said transformation combination, then sequentially arranges each merged acoustic-prosodic model to generate a merged acoustic-prosodic model sequence, and said merged acoustic-prosodic model sequence is further applied to said speech synthesizer to synthesize said inputted text into an L2 speech with an L1 accent based at least partly on the transformation combination determined by the controllable accent weighting parameter.

7. A multi-lingual text-to-speech method, executed on a computer system, said computer system having a memory device for storing at least a first and a second language acoustic-prosodic model sets, said method comprising:

for an inputted text with second-language (L2) and L2 phonetic unit transcription corresponding to said inputted text to be synthesized, finding a second acoustic-prosodic model corresponding to each phonetic unit of said L2 phonetic unit transcription in an L2 acoustic-prosodic model set, searching an L2-to-L1 phonetic unit transformation table, L1 being a first language, and using at least a controllable accent weighting parameter to determine a transformation combination to select a corresponding L1 phonetic unit transcription and find a first acoustic-prosodic model corresponding to each phonetic unit of said L1 phonetic unit transcription in an L1 acoustic-prosodic model set;

merging said first and said second acoustic-prosodic models into a merged acoustic-prosodic model according to said at least a controllable accent weighting parameter, processing all transformations in said transformation combination, and generating a merged acoustic-prosodic model sequence; and applying said merged acoustic-prosodic model set to a speech synthesizer to synthesize said inputted text into an LI-accent L2 speech based at least partly on the transformation combination determined by the controllable accent weighting parameter.

8. The method as claimed in claim 7, said method further comprising constructing said phonetic unit transformation table, said constructing phonetic unit transformation table further comprising:

selecting a plurality of audio files and a plurality of L2 phonetic unit transcriptions corresponding to said audio files from an L2 speech bank;

for each selected audio file, said L1 acoustic-prosodic model performing a free syllable speech recognition to generate a recognition result and transform said recognition result into an L1 phonetic unit transcription, using a dynamic programming to perform phonetic unit alignment on said L2 phonetic unit transcription corresponding to said audio file and said L1 phonetic unit transcription, after finishing dynamic programming, a transformation combination being obtained; and accumulating statistics from the obtained plurality of transformation combinations in above step to generate said phonetic unit transformation table.

9. The method as claimed in claim 8, wherein said dynamic programming further comprises using Bhattacharyya distance, used in statistics to compute distance between two discrete probability distributions, to compute local distance between two acoustic-prosodic models.

10. The method as claimed in claim 7, wherein said phonetic unit transformation table comprises three types of transformation, and said three types of transformation are substitution, insertion and deletion.

11. The method as claimed in claim 10, wherein substitution is a one-to-one transformation, insertion is a one-to-many transformation and deletion is a many-to-one transformation.

12. The method as claimed in claim 8, said method uses said dynamic programming to find at least a corresponding phonetic unit and at least a transformation type for said inputted text to be synthesized.

13. The method as claimed in claim 7, wherein said merged acoustic-prosodic model further comprises a Gaussian density function $g_{new}(\mu_{new},\Sigma_{new})$, expressed as:

$$\mu_{new}=w*\mu_1+(1-w)*\mu_2$$

$$\Sigma_{new}=w*(\Sigma_1+(\mu_1-\mu_{new})^2)+(1-w)*(\Sigma_2+(\mu_2-\mu_{new})^2)$$

where said first acoustic-prosodic model is expressed by a Gaussian density function $g_1(\mu_1, \Sigma_1)$, said first acoustic-prosodic model is expressed by another Gaussian density function as $g_2(\mu_2, \Sigma_2)$, $\mu$ is average vector and $\Sigma$ is co-variance matrix, $0 \leq w \leq 1$.

14. The method as claimed in claim 8, wherein said generating said recognition result further comprises performing a free tone recognition.

* * * * *

UNITED STATES PATENT AND TRADEMARK OFFICE

CERTIFICATE OF CORRECTION

PATENT NO. : 8,898,066 B2
APPLICATION NO. : 13/217919
DATED : November 25, 2014
INVENTOR(S) : Jen-Yu Li et al.

It is certified that error appears in the above-identified patent and that said Letters Patent is hereby corrected as shown below:

Title page, item (75) Inventors should read: Jen-Yu Li, Taipei (TW); Jia-Jang Tu, Hsinchu (TW); Chih-Chung Kuo, Hsinchu (TW)

Signed and Sealed this
Twenty-first Day of April, 2015

Michelle K. Lee

Michelle K. Lee
*Director of the United States Patent and Trademark Office*